US008220219B2

(12) United States Patent
Martter

(10) Patent No.: US 8,220,219 B2
(45) Date of Patent: Jul. 17, 2012

(54) REINFORCING ASSEMBLY, AND REINFORCED CONCRETE STRUCTURES USING SUCH ASSEMBLY

(76) Inventor: Richard P. Martter, Dallas, TX (US)

( * ) Notice: Subject to any disclaimer, the term of this patent is extended or adjusted under 35 U.S.C. 154(b) by 0 days.

(21) Appl. No.: 12/959,912

(22) Filed: Dec. 3, 2010

(65) Prior Publication Data

US 2012/0137618 A1 Jun. 7, 2012

(51) Int. Cl.
*E04H 12/00* (2006.01)

(52) U.S. Cl. ..... 52/649.1; 52/633; 52/680

(58) Field of Classification Search ..... 52/649.1, 52/633, 638, 680, 682, 677, 686, 687
See application file for complete search history.

(56) References Cited

U.S. PATENT DOCUMENTS

| | | | | | |
|---|---|---|---|---|---|
| 1,620,501 | A | * | 3/1927 | Vogel | 52/686 |
| 2,420,860 | A | * | 5/1947 | Burner | 52/686 |
| 2,783,695 | A | * | 3/1957 | De Canio | 404/62 |
| 3,400,508 | A | * | 9/1968 | Dietner et al. | 52/691 |
| 4,406,103 | A | | 9/1983 | Ghali et al. | |
| 4,612,747 | A | | 9/1986 | Andra et al. | |
| 4,689,867 | A | * | 9/1987 | Tolliver | 29/453 |
| 4,865,781 | A | * | 9/1989 | Jennings | 264/35 |
| 4,996,816 | A | * | 3/1991 | Wiebe | 52/677 |
| 5,655,349 | A | | 8/1997 | Ghali et al. | |
| 5,815,999 | A | * | 10/1998 | Williams | 52/223.13 |
| 5,992,123 | A | | 11/1999 | Kies | |
| 6,003,281 | A | | 12/1999 | Pilakoutas | |
| 6,052,962 | A | | 4/2000 | Ghali et al. | |
| D445,668 | S | * | 7/2001 | Hills, Sr. | D8/354 |
| 6,327,832 | B1 | | 12/2001 | Ernst et al. | |
| 6,385,930 | B1 | | 5/2002 | Broms et al. | |
| 7,540,121 | B2 | | 6/2009 | Haeussler | |
| 7,784,235 | B2 | | 8/2010 | Cretti | |
| 2003/0154674 | A1 | | 8/2003 | Matthaei et al. | |
| 2008/0263978 | A1 | | 10/2008 | Abou-Saleh | |

(Continued)

OTHER PUBLICATIONS

A.H. Mattock, "Shear Transfer in Concrete Having Reinforcement At An Angle to the Shear Plane", 1973, p. 17-42.

(Continued)

*Primary Examiner* — Basil Katcheves

(57) ABSTRACT

A reinforcing assembly to address this problem comprises a plurality of diagonal working members (preferably formed of #3 rebar) each of which is "ribbed" to provide increased surface area for bonding to the concrete, and each of which is attached to a horizontal runner independently such that the diagonal working members are variably spaced along the assembly. Relative to the horizontal runner, each diagonal member is "bent" at a given angle, preferably in the range of 45° plus or minus 25°. The reinforcing assembly is designed for use to provide punching shear reinforcement in a reinforced concrete structure such as, without limitation, a slab (in which the assembly is supported) located adjacent a structural column. The top of each diagonal member in the reinforcing assembly preferably comprises a double hook that is configured to fit within reinforcing bars that run along the top of the slab. The horizontal runner comprises a pair of spaced-apart, longitudinally-extending carrier (or "support") bars, each of which preferably terminates on one end (namely, at the support column) at one end in a structure that is bent upwards and hooked. Preferably, the hooked structure of each runner bar extends into the structural column to provide additional reinforcement, thereby converting the runner bar into a reinforcing member that provides the same function as the other diagonal members, and at a confined location at a highest point of stress (i.e. where the slab attaches to the column) where it would not be possible otherwise to fit a diagonal member.

23 Claims, 3 Drawing Sheets

U.S. PATENT DOCUMENTS

2009/0188201 A1 7/2009 Ghali et al.

OTHER PUBLICATIONS

Mark Ritchie, et al., "Seismic-Resistant Connections of Edge Columns with Prestressed Slabs", ACI Structural Journal, vol. 102, No. 2, Mar.-Apr. 2005, 10 pages.

Amin Ghali, "An Efficient Solution to Punching of Slabs", Concrete International, 1989, p. 50-54.

Zaher Abou Saleh, et al., "Punching Shear Capacity of Post-Tensioned Slab with Hairpin Shaped Reinforcements", PTI Journal, Jul. 2007, p. 39-48.

Adel A. Elgabry, et al., "Design of Stud-Shear Reinforcement for Slabs", ACI Structural Journal, vol. 87, No. 3, May-Jun. 1990, 12 pages.

Dr.-Ing. Josef Hegger, et al., "New reinforcement technology (Part 1)", Reinforcement technology, Aug. 2008, p. 4-13.

International Search Report dated Apr. 19, 2012 in connection with International Patent Application No. PCT/US2011/63299.

Written Opinion of International Searching Authority dated Apr. 19, 2012 in connection with International Patent Application No. PCT/US2011/63299.

* cited by examiner

REINFORCING ASSEMBLY, AND REINFORCED CONCRETE STRUCTURES USING SUCH ASSEMBLY

BACKGROUND

1. Technical Field

This disclosure relates generally to reinforcing assemblies for use in structural concrete members.

2. Background of the Related Art

Commercial concrete is a mixture of cement, sand and stone aggregate held together in a rigid structure by the addition of water. So-called "unreinforced" concrete has fairly good resistance to compressive stresses, however, any significant tension tends to break the structure and cause undesirable cracking and separation. To address this problem, concrete is typically "reinforced" by embedding in place (within the rigid structure) a solid member made of a material with high strength in tension. Reinforced concrete structures are available commercially in many shapes and sizes, such as slabs, beams, footings and flat foundations.

Commercial and industrial structural concrete members, even when made with reinforced concrete, are highly susceptible to shear forces that create diagonal tensile forces within them, which can result in structural failure. The cracking and/or breaking caused by these shear forces tend to propagate throughout the concrete structure. In horizontal concrete members (such as slabs, footings and flat foundations), this problem is known as "punching shear failure." The problem is especially acute in concrete members when supported by columns. In this situation, the concrete member is subject to a concentration of stress in a zone near the column, wherein the column tends to "punch" through the member. The resulting shearing force creates diagonal tension stresses within the supported member. The concrete is particularly vulnerable to these tensile stresses and thus must have reinforcement, such as embedded steel members, to prevent tensile failure, crack propagation, and consequent structural collapse.

The prior art has addressed the problem of punching shear failure by providing assemblies and reinforcing techniques such as described in U.S. Pat. No. 4,406,103. According to this patent, shear reinforcement is provided by a plurality of substantially vertical elongate reinforcing elements (smooth shafts) fixedly attached in spaced horizontal relation to support means, wherein each element is provided (at the upper end) with an enlarged (flange) portion, which serves as an anchor when the reinforcement is embedded within the concrete slab. At the lower end is a flat steel bar, which serves as a base structure and as a lower end anchorage. In a preferred form, the element consists of thin transverse sections. A commercial product incorporating this design is known as the "Stud-Rail" system.

While the Stud-Rail system is well-known and widely-used, it is not an optimal solution to the problem of punching shear failure. As noted above, the system uses smooth shafts for reinforcing, but those shafts have no means to grip the concrete in the area of primary crack formation. Thus, in operational mode, the stresses from diagonal tension must stretch the concrete (in the vulnerable crack zone) away from the center of the slab, accumulating in proportion to the load and the thickness of the concrete until restrained by a flange at the top or the bottom shaft, i.e. near the surface of the top or bottom of the slab thickness. This restraining force places the shaft itself in tension from one end to the other, which causes the shaft to undergo significant strain. In addition, there is a compressive strain in the compressed zones under the flange at the top and bottom of the shafts. To maintain equilibrium, the sum of the top and bottom compression strains under the flanges, and the tensile strain in the shaft of the studs must be equal to the tensile strain in the central zone of the slab thickness. But, because the total thickness of the top and bottom compression zones are roughly equal to the thickness of the tension zone in the center, because the strain in the shafts is additive to the concrete compression strains, and further because the tensile strain in the central concrete zone must equal the sum of the above two strains, the tensile stress in the central concrete zone must be commensurately higher. In response to these high stresses, cracks still are able to form and propagate at relatively low loads. Another deficiency of the Stud-Rail system is that the reinforcement does not start working (albeit inefficiently, for the reasons stated above) until a crack has started; the structure and reinforcing technique do not act as a prophylactic to prevent such cracks in the first instance.

There remains a long-felt need in the art to provide enhanced concrete structure reinforcing assemblies that overcome the deficiencies of current state-of-the-art systems for punching shear reinforcement.

BRIEF SUMMARY

The inventor has recognized that current state-of-the-art systems for punching shear reinforcing in slabs are deficient in that they are designed primarily with smooth vertical members that do not provide protection against shear stress in an area of the slab where shear cracks originate, namely, the central zone of the slab. In particular, near the top surface of the slab, known reinforcing assembles often include a horizontal rebar that is placed to withstand tensile bending stresses. This rebar also acts to withstand a horizontal component of the diagonal shear. At the bottom of the slab, there is compressive stress due to bending, and this stress neutralizes the horizontal component of the diagonal tension stress. In the central zone of the slab thickness, however, prior art structures provide nothing to reduce or neutralize the horizontal component of the diagonal tension. There, the magnitude of the tensile stress in that area is magnified, and this is the location where the shear cracks originate and thus where reinforcing is most necessary.

A reinforcing assembly to address this problem comprises a plurality of diagonal working members (preferably formed of #3 rebar) each of which is formed with protruding "ribs" to provide mechanical anchorage for the concrete to grip, and each of which is attached at its bottom end to a horizontal runner independently such that the diagonal working members are variably spaced along the assembly. Relative to the horizontal runner, each diagonal member is "bent" at a given angle, preferably in the range of 45° plus or minus 25°. A preferred orientation is approximately 45°. The reinforcing assembly is designed for use to provide punching shear reinforcement in a reinforced concrete structure such as, without limitation, a slab (in which the assembly is supported) located adjacent to a structural column. The top of each diagonal member in the reinforcing assembly preferably comprises a double hook that is configured to fit within reinforcing bars that run in both directions along the top of the slab. The horizontal runner comprises spaced-apart, longitudinally-extending carrier (or "support") bars, each of which preferably terminates on one end (namely, at the support column) at one end in a structure that is bent upwards and hooked. Preferably, the hooked structure of each runner bar extends into the structural column, thereby converting the runner bar into a reinforcing member that provides the same function as the other diagonal members, and at a confined location at a highest point of stress (i.e. where the slab attaches to the column) where it would not be possible otherwise to fit a diagonal member.

The diagonal working members are located perpendicular to the zone of nascent diagonal cracking and thus provide significantly greater punching shear reinforcement protection. In particular, the tensile reinforcement provided by the reinforcing assembly aligns in parallel with the stresses it is intended to resist. The ribbed characteristic of each diagonal working member provides maximum surface area for concrete bonding and provide mechanical interlock for the transfer of concrete stresses to the rebar, and the spacing of the working members preferably is such that the members are closer together near the column (where stresses are highest), while transitioning to a progressively wider spacing away from the column where stresses are lower. Further, the preferably small diameter of the rebar provides maximum surface area for bonding interaction per unit weight of rebar.

The foregoing has outlined some of the more pertinent features of the invention. These features should be construed to be merely illustrative. Many other beneficial results can be attained by applying the disclosed invention in a different manner or by modifying the invention as will be described.

BRIEF DESCRIPTION OF THE DRAWINGS

For a more complete understanding of the subject matter herein and the advantages thereof, reference is now made to the following descriptions taken in conjunction with the accompanying drawings, in which.

DETAILED DESCRIPTION OF AN ILLUSTRATIVE EMBODIMENT

Figure 1:
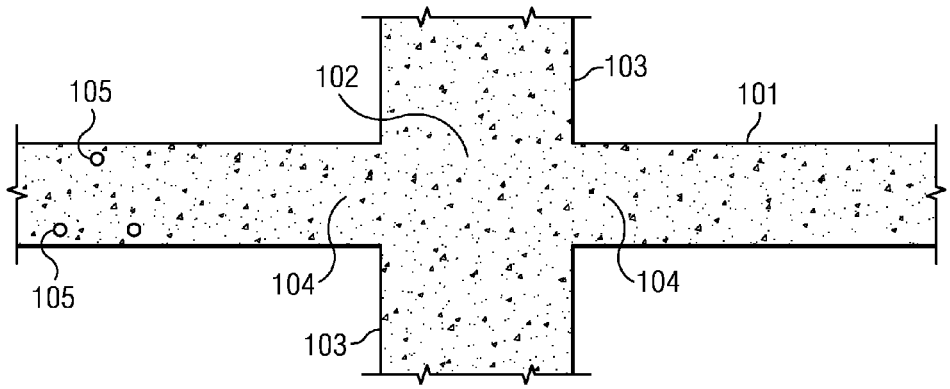
FIG. 1 is a cross-sectional view of a concrete slab structure at an area surrounding the intersection of the slab structure with a supporting column showing high stress locations where undesirable cracking caused by punching shear forces typically occurs.

FIG. 1 is a cross-sectional view of a concrete slab structure at an area surrounding the intersection of the slab structure with a supporting column showing undesirable cracking caused by punching shear forces. The column may be a steel supporting column, a concrete supporting column, or the like. In this example, a concrete slab 101 is attached to a support column 103. The concrete slab typically includes internal structural components that provide reinforcement. These include reinforcing bar (or "rebar"), which typically is formed of carbon steel and used in reinforced concrete and masonry structures. In a typical embodiment, rebar 105 extends across the top of the slab (into and out of the view as shown), as well as across the bottom of the slab (although rebar in the bottom is not always used). Reference numeral 102 represents a load or "reaction" area; punching shear failure causes cracks, particular in areas of high stress, such as indicated by reference numerals 104.

Figure 2:
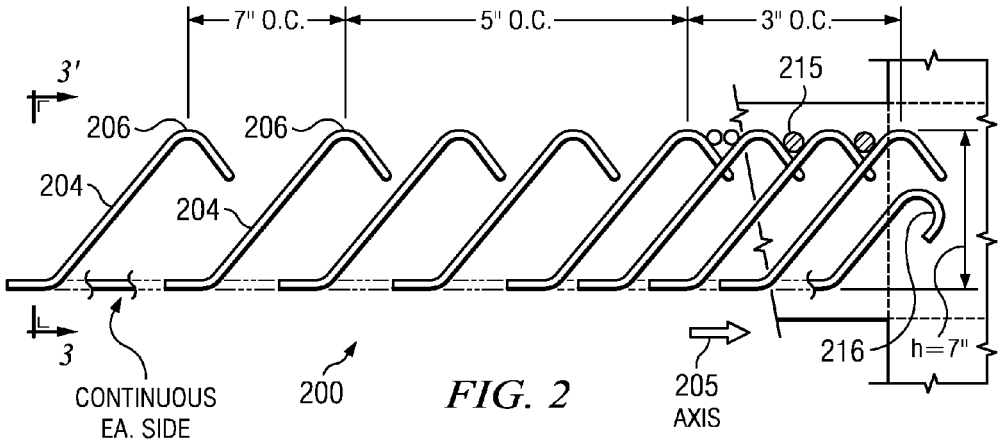
FIG. 2 is an elevation view of a reinforcing assembly according to this disclosure.
Figure 3:
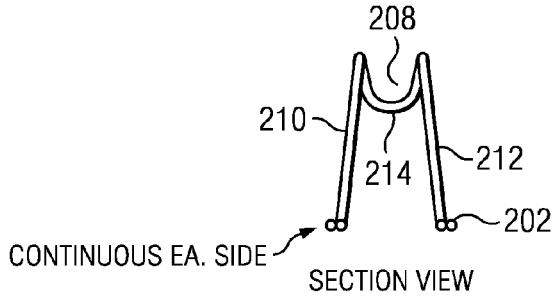
FIG. 3 is a sectional view taken along lines 3-3' of FIG. 2.
Figure 4:
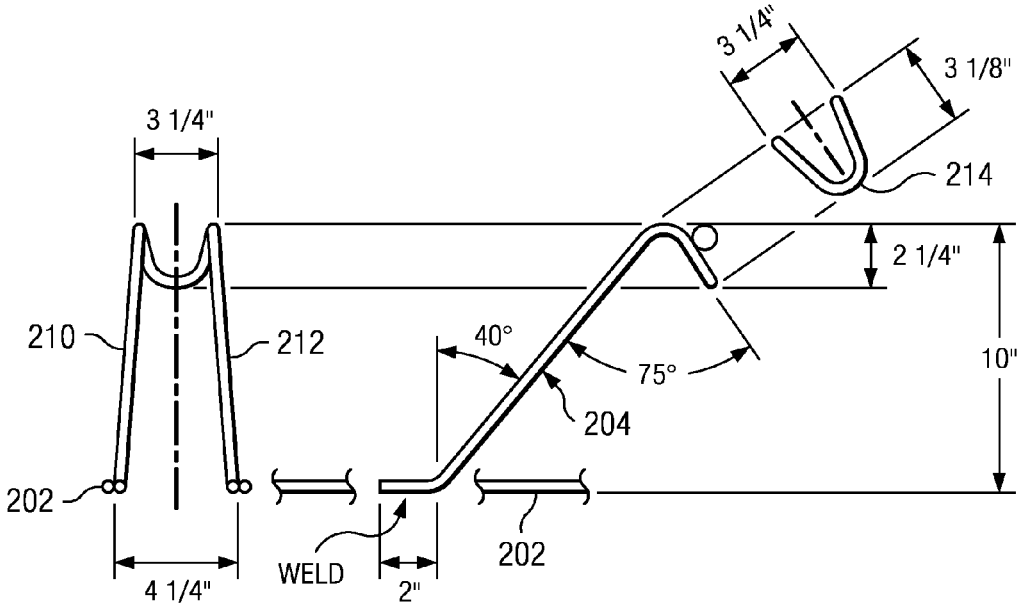
FIG. 4 illustrates section, elevation and plan views of one of the working members of the reinforcing assembly.
Figure 5:
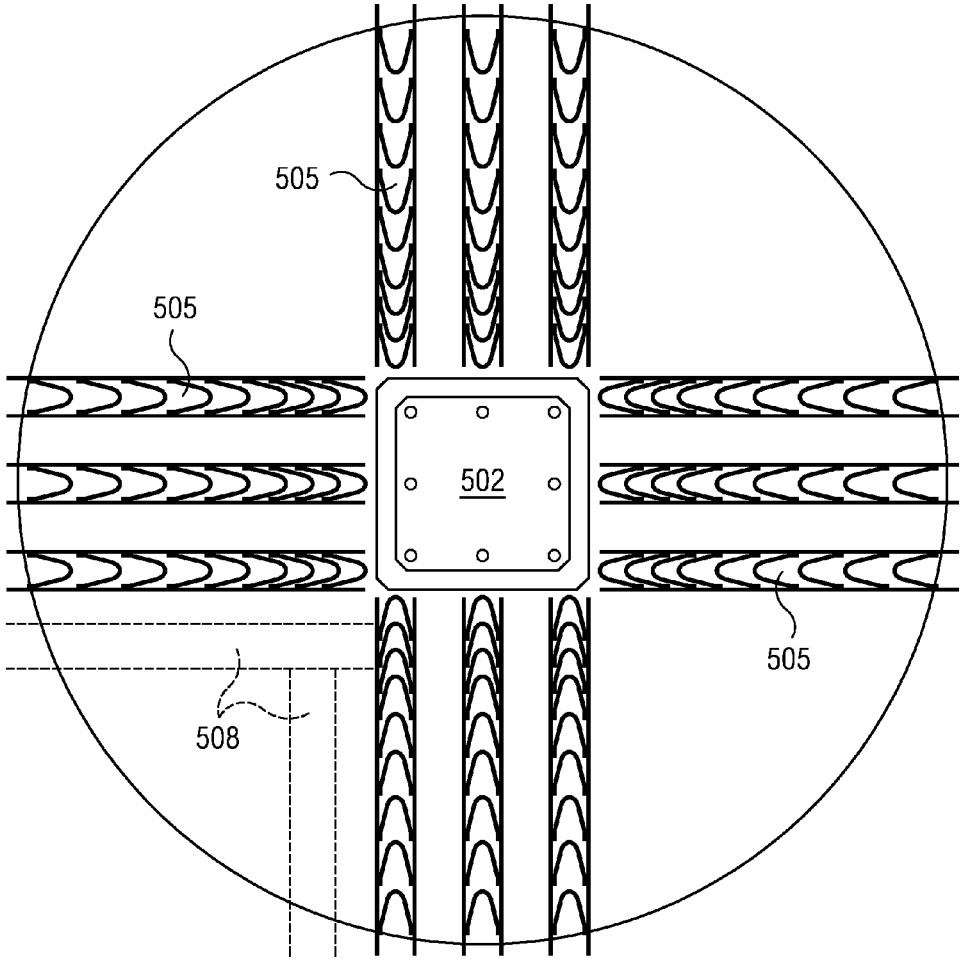
FIG. 5 illustrates a plan view of the concrete slab with an arrangement of bar truss reinforcing assemblies according to the teachings of this disclosure.

With reference now to FIG. 2, FIG. 3 and FIG. 4, the novel reinforcing assembly of this disclosure is illustrated. This reinforcing assembly is adapted to be formed within (i.e. embedded in) the concrete slab 101 of FIG. 1. FIG. 5 illustrates that a plurality of such reinforcing assemblies typically are embedded within the concrete slab. In this embodiment, which is merely illustrative, three (3) reinforcing assemblies are positioned side-by-side at each orthogonal position. The concrete column 502 typically is 16-24 inches square, and the reinforcing assemblies 500 extend outwardly to provide an overall "zone" 505 of concrete reinforcement. The reinforcing assemblies typically are in the range of 2-4 feet long, although this is not a limitation. One or more additional trusses 508 may be used for high-stress conditions.

FIG. 2 is an elevation view of the reinforcing assembly 200, and FIG. 3 is a sectional view taken along lines 3-3' of FIG. 2. FIG. 4 illustrates section, elevation and plan views of one of the working members of the reinforcing assembly. Referring to these drawings, the reinforcing assembly 200 comprises a pair of spaced-apart, longitudinally-extending support or "carrier" bars 202. A plurality of working members 204 are attached, preferably by welding, to the longitudinally-extending support bars 202. FIG. 3 shows a preferred attachment. Each working member 204 is oriented diagonally with respect to a longitudinal axis 205 that extends along the support bars 202. As best seen in FIG. 3 and FIG. 4, each working member comprises a top 206 that is an upper extent of the working member and the point from which a downwardly-extending hook portion 208 (of the working member) extends. Each working member preferably comprises first and second upstanding sides 210 and 212, and a central connecting section 214 bent downward from the uppermost section. This "turn-down" at the top of each working member facilitates near full anchorage along the top of the concrete while at the same time ensuring that the reinforcing assembly does not interfere with the rebar 215 in either direction. (The rebar 215 typically is not part of the reinforcing assembly itself). This configuration allows the uppermost portions of the working members to extend to a close distance (e.g., ¾ inch) of the top surface of the slab, which is desirable so that the working members engage the full section of slab concrete and provide full efficiency. The central connecting section 214 provides an "up-turn" that extends to connect the upstanding sides 210 and 212 to one another such that the working member is an integral unit. This central connecting section provides an additional stabilizing connection plus provides a cup-shaped support for the rebar 215 (running parallel to the truss assembly, as shown).

Preferably, each working member 204 is angled with respect to the runner bars 202 at a predetermined angle lying within a range of 45° plus or minus 25°. A preferred bending angle of the working member is 45°. As shown in FIG. 3, this bend allows for a longitudinal weld between the runner bar and the bottom end of the working member. The weld may be extended as required to develop a full strength of the bar. In use, the weld is stressed longitudinally and thus is able to develop the full strength of the bar and provide full bottom anchorage.

Automated machinery may be used to configure the working members, preferably in a single pass.

Each longitudinally-extending support bar 202 preferably terminates on one end in a structure 216 that is bent upwards and hooked. This structure is designed to extend into the column to provide additional support in an area of maximum stress.

As best seen in FIG. 2, spacing between at least first and second successive pairs of working members along the length of the reinforcing assembly varies. Thus, in this embodiment, which is not limiting, the spacing between working successive pairs of working members is 3 inches in a first portion of the reinforcing assembly that is closest to the column. In a second portion, this spacing increases to 5 inches, while in a third portion (that is furthest away from the column), this inter-working member spacing extends to 7 inches. Generalizing, the spacing between each successive pair of working members increases along the length of the reinforcing assembly.

The working members and the runner bars on which they are disposed are preferably formed of rebar and, in particular, #3 rebar. Preferably, a smallest diameter rebar is used, and preferably the surface of the rebar is ribbed or knurled along its entire length.

The preferred dimensions of the working members are set forth in the figures, although one of ordinary skill will appreciate that these dimensions are merely exemplary.

The progressive spacing between the diagonal working members will depend on the size of the slab, the size of the column, and the anticipated loads. In one embodiment, a smallest unit-to-unit spacing is on the order of 3 inches, with spacing further out from the column then progressing to 5 inches, then 7 inches, and so forth. In an alternative embodiment, non-uniform spacing between the diagonal members may be used, e.g., with each successive spacing (away from the column) being a fixed percentage larger than a succeeding one (closer to the column), but with no spacing (except possibly the first, or the first and second) being the same. In another embodiment, the spacing varies incrementally in fractional-inch increments.

The reinforcing assembly is sometimes referred to herein as a "bar truss" whose "diagonal working members" may sometimes be referred to bar truss "units." As shown in the drawings, each of the basic units preferably is bent into six (6) different planes before being welded to the runner bars. The runner (carrier) bars preferably are bent with hooks at their inside (support) ends to furnish additional gripping action at the location of highest stress and of load transfer. The truss bars units are each placed diagonally to engage any nascent cracks at a 90° or near 90° angle (with respect to the crack itself), which provides maximum efficiency in terms of aligning the units to directly oppose the shear (splitting) force. By being placed diagonally, each unit traverses a much higher percentage of the potential crack zone per unit length as compared to a vertical orientation. The diagonal placement further enables each unit to engage up to twice as many crack zones per unit. Preferably, at the top of each unit there is a curved "bridge" section which joins the two upstanding sides of the unit. A central connecting section preferably is bent downward from an uppermost section. This bent section, which is preferably comprised of three (3) curves, has several functions and advantages: it provides a very efficient hooked anchorage for the top end of each unit (without the requirement of any additional material), it minimizes conflict with any horizontally-extending rebar (in the slab, which rebar is distinct from the reinforcing assembly), and it performs a bridging function, connecting the two upstanding sides of each unit. Further, its compact size allows it to penetrate upward between even dense top rebar concentrations, and to engage to full depth of structural slab thickness.

Thus, in a preferred embodiment, each truss bar unit in the reinforcing assembly is oriented diagonally, has a knurled (ribbed) surface (preferably along its full length), and is formed of a small diameter (#3) rebar material. This size of rebar has the highest ratio of surface area to cross-sectional area, thus increasing its ability to bond most effectively to the concrete around it, and yet it is stiff enough to maintain its shape during concrete placement. The use of #3 rebar is not a limitation, however, as other types of materials (including #4 rebar, #5 rebar, and the like) may be used. Moreover, while the drawings illustrate that the preferred reinforcing assembly comprises a plurality of diagonal working members whose spacing from one another varies progressively from an inner to an outer end (relative to the column), this is not a limitation either. A reinforcing assembly having at least one diagonal working member having the structural characteristics described and illustrated above is within the scope of the claims that are set forth below.

The reinforcing assembly described above and illustrated in the figures provides numerous advantages over the prior art. The angled (diagonal) orientation of the truss bar units places them at approximately a perpendicular position to the potential diagonal-stress punching shear cracks. The ribbed surface of the units provides maximum efficiency in engaging the concrete at the points of maximum stress, thus preventing the crack from beginning in the first instance. Because the assembly inhibits any crack at the point of maximum stress, and because the structure provides similar reinforcing crossing the crack zone above and below this point, the crack (if it does occur) cannot propagate (extend). If the crack does not occur, or if it is held to a very narrow width, the very significant strength of the concrete will continue to maintain its integrity, thereby enabling the slab (in which the reinforcing assembly is embedded) to carry shear loads. The rebar and the concrete thus work together, and their respective strengths are additive, rather than (as in the prior art) the concrete failing and transferring all of its load-carrying ability to the smooth steel studs or similar reinforcing.

The ribbed reinforcing provided by each angled truss bar unit develops a bond with the concrete with which it is in contact, thus preventing crack origination and/or propagation, because the unit bonds to the concrete on both sides on the crack zone and prevents those concrete segments from moving apart from one another. Thus, the cracking process cannot begin under usual loads. The rebar works with the concrete and supplements it, rather than simply going to work after the concrete has already failed (as in the prior art).

The assembly is easy to manufacture. Preferably, the entire assembly is made of pieces of available materials (such as #3 rebar), and those pieces are readily bent and welded into the assembly using conventional (and preferably automated) manufacturing techniques.

A reinforced concrete structure according to this disclosure is any structure such as a slab, a beam, a footing, a flat foundation, etc. or the like that includes a reinforcing assembly of the type described above and illustrated in the drawings.

As illustrated in the drawings and as described above, each working member preferably has a downwardly-concave hook at its top end, which hook joins each end of an upwardly-concave, laterally-positioned hook that is centered on a centerline of the assembly. The upwardly concave hook forms a structural lateral link between the two upstanding side portions of the working member, thus forming a pair. The upwardly-concave hook preferably is below the level of the horizontal structure rebar, which is in the top level of the slab. The lower end of each working member, which is an angled terminus placed on an inside face of the lower carrier bar at the bottom of the assembly, preferably is located at a lowest possible portion in the slab depth, thus maximizing its embedded length in the slab and allowing an efficient, automatic, in-line, one-pass weld for the entire assembly.

With reference to the cross-sectional view of the described assembly in FIG. 3, a view perpendicular to the horizontal axis, it is seen that the upper width of the assembly is approximately 3 inches and the lower width is approximately 5 inches (in the illustrated embodiment only, and not intended to be limiting). The wider width at the bottom provides stability against overturning. The tapered sides allow a wider base.

Although the use of small (ribbed) rebar requires more members to be used, this provides an advantage in that it allows a more dispersed distribution of the individual working members in the concrete, thus allowing the steel reinforcing to blend into the concrete material and act more as an integral part of the concrete itself.

Having described my invention, what I now claim is as follows.

The invention claimed is:

1. A reinforcing assembly for use in a reinforced concrete structure, the reinforcing assembly comprising:

a pair of spaced-apart, longitudinally-extending support bars; and a plurality of working members each attached to the support bars and oriented diagonally with respect to a longitudinal axis that extends along a length of the support bars, each working member comprising a ribbed reinforcing material and having at a top thereof a downwardly-extending hook portion, each working member attached to the support bars independently;

wherein the diagonally-oriented working members are arranged so that, when the reinforcing assembly is viewed from its side, part of one working member is located over part of a neighboring working member in a direction perpendicular to the longitudinal axis; and wherein the diagonally-oriented working members are configured to provide reinforcement against diagonal punching shear stress in the reinforced concrete structure.

2. The reinforcing assembly of claim 1, wherein each working member comprises #3 rebar.

3. The reinforcing assembly of claim 1, wherein each working member is oriented at substantially 45° with respect to the longitudinal axis.

4. The reinforcing assembly of claim 1, wherein each support bar terminates on one end in a structure that is bent upwards and hooked.

5. The reinforcing assembly of claim 4, wherein each support bar comprises #3 rebar.

6. The reinforcing assembly of claim 1, wherein a spacing between each successive pair of working members increases along the length.

7. The reinforcing assembly of claim 1, wherein each working member comprises an upwardly extending portion that joins the downwardly-extending hook portion of that working member.

8. The reinforcing assembly of claim 1, wherein each working member is welded to the support bars.

9. The reinforcing assembly of claim 1, wherein each working member comprises a pair of sides that taper outwardly from top to bottom.

10. The reinforcing assembly of claim 1, wherein:

each working member comprises an upwardly extending portion having substantially straight sides defining a plane; and the downwardly-extending hook portion of each working member projects outside of the plane defined by the sides of that working member.

11. The reinforcing assembly of claim 1, wherein:

each working member comprises an upwardly extending portion having substantially straight sides; and the sides of all working members are substantially parallel with each other when the reinforcing assembly is viewed from its side.

12. The reinforcing assembly of claim 1, wherein:

each working member comprises an upwardly extending portion having a pair of sides; and each side has an end at its bottom that is bent at an angle and that is attached to one of the support bars.

13. A reinforced concrete structure comprising:

a concrete member; and a reinforcing assembly embedded within the concrete member, the reinforcing assembly comprising:

a pair of spaced-apart, longitudinally-extending support bars; and a plurality of working members each attached to the support bars and oriented diagonally with respect to a longitudinal axis that extends along a length of the support bars, each working member comprising a ribbed reinforcing material and having at a top thereof a downwardly-extending hook portion, each working member attached to the support bars independently;

wherein the diagonally-oriented working members are arranged so that, when the reinforcing assembly is viewed from its side, part of one working member is located over part of a neighboring working member in a direction perpendicular to the longitudinal axis; and wherein the diagonally-oriented working members are configured to provide reinforcement against diagonal punching shear stress in the concrete member.

14. The reinforced concrete structure of claim 13, wherein the concrete member comprises a slab.

15. The reinforced concrete structure of claim 13, wherein each working member comprises rebar.

16. The reinforced concrete structure of claim 13, wherein each working member is oriented at substantially 45° with respect to the longitudinal axis.

17. The reinforced concrete structure of claim 13, wherein each support bar terminates on one end in a structure that is bent upwards and hooked.

18. The reinforced concrete structure of claim 13, wherein a spacing between each successive pair of working members increases along the length.

19. The reinforced concrete structure of claim 13, wherein each working member comprises an upwardly extending portion that joins the downwardly-extending hook portion of that working member.

20. The reinforced concrete structure of claim 13, wherein each working member is welded to the support bars.

21. A method of reinforcing, the method comprising:

positioning a reinforcing assembly within a concrete slab, the reinforcing assembly comprising a plurality of working members each attached to longitudinally-extending support bars and oriented diagonally with respect to a longitudinal axis that extends along a length of the support bars, each working member comprising a ribbed reinforcing fibbed material and having at a top thereof a downwardly-extending hook portion, each working member attached to the support bars independently; and attaching the concrete slab to a structural column;

wherein the diagonally-oriented working members are arranged so that, when the reinforcing assembly is viewed from its side, part of one working member is located over part of a neighboring working member in a direction perpendicular to the longitudinal axis; and wherein the diagonally-oriented working members provide reinforcement against diagonal punching shear stress in the concrete slab.

22. A reinforcing assembly comprising:

a pair of spaced-apart, longitudinally-extending support bars comprising #3 rebar; and multiple working members welded to the support bars and oriented at a substantially 45° angle with respect to a longitudinal axis that extends along the support bars, each working member comprising #3 rebar and having at a top thereof a downwardly-extending hook portion;

wherein the diagonally-oriented working members are arranged so that, when the reinforcing assembly is viewed from its side, part of one working member is located over part of a neighboring working member in a direction perpendicular to the longitudinal axis; and wherein the diagonally-oriented working members are configured to provide reinforcement against diagonal punching shear stress in a reinforced structure.

23. The reinforcing assembly of claim 22, wherein each working member comprises a pair of sides that taper outwardly from top to bottom.

* * * * *